US005152592A

United States Patent [19]

Krayer

[11] Patent Number: 5,152,592

[45] Date of Patent: * Oct. 6, 1992

[54] CORNER CABINET

[76] Inventor: William L. Krayer, 1623 Tiffany Ridge, Pittsburgh, Pa. 15241

[ * ] Notice: The portion of the term of this patent subsequent to Sep. 23, 1997 has been disclaimed.

[21] Appl. No.: 898,651

[22] Filed: Aug. 21, 1986

Related U.S. Application Data

[63] Continuation-in-part of Ser. No. 821,047, Jan. 22, 1986, abandoned.

[51] Int. Cl.[5] ..... A47B 81/00

[52] U.S. Cl. ..... 312/238; 312/305

[58] Field of Search ..... 312/238, 305, 125, 135, 312/11, 350; 279/16; 108/94, 104, 139, 142, 20; 211/144

[56] References Cited

U.S. PATENT DOCUMENTS

| | | | |
|---|---|---|---|
| D. 211,527 | 6/1968 | Rowland | D6/489 X |
| D. 215,735 | 10/1969 | Melvin | D6/489 X |
| D. 262,169 | 12/1981 | Sonder et al. | D6/489 X |
| 1,241,175 | 9/1917 | Watts . | |
| 1,241,176 | 9/1917 | Watts . | |
| 1,241,177 | 9/1917 | Watts . | |
| 2,239,734 | 4/1941 | Pratt . | |
| 2,628,880 | 2/1953 | Kader . | |
| 2,629,643 | 2/1953 | Davidson . | |
| 2,680,660 | 6/1954 | Stephens . | |
| 2,693,401 | 11/1954 | Brown . | |
| 2,840,438 | 6/1958 | Sharpe | 211/144 X |
| 3,160,453 | 12/1964 | Tassell . | |
| 3,198,594 | 8/1965 | Murray . | |
| 3,369,320 | 2/1968 | Hronas et al. . | |
| 3,922,120 | 11/1975 | McCullough et al. . | |
| 4,012,077 | 3/1977 | Roepke et al. . | |
| 4,062,595 | 12/1977 | Roepke et al. . | |
| 4,074,778 | 2/1978 | Morrell et al. . | |
| 4,124,262 | 11/1978 | Schill . | |
| 4,146,280 | 3/1979 | Crownhart . | |
| 4,191,437 | 3/1980 | Funke . | |
| 4,330,696 | 5/1982 | Pomeroy et al. | 108/20 X |
| 4,392,628 | 7/1983 | Hadfield . | |
| 4,433,885 | 2/1984 | Baker . | |
| 4,434,343 | 2/1984 | Bowen et al. | 108/20 X |

FOREIGN PATENT DOCUMENTS

| | | | |
|---|---|---|---|
| 803415 | 4/1951 | Fed. Rep. of Germany | 211/144 |
| 965431 | 9/1950 | France | 312/305 |

OTHER PUBLICATIONS

The Kinematics of Machinery by Franz Reuleaux, Dover Publications, pp. 131–168.

Scientific American, Feb. 1963, pp. 148–156, article by Martin Gardner, "Mathematical Games".

REMark, May 1985, pp. 30 et seq. "Spiral Magic on the H/Z 100" by Gary Cramblitt.

*Primary Examiner*—Joseph Falk

[57] ABSTRACT

A shelf arrangement is disclosed for a corner cabinet, particularly for a built-in cabinet such as is commonly used in kitchens. The shelf is shaped as a closed curve of constant width, preferably triangular. The shelf turns in the confines of a square-shaped corner cabinet space; a corner of the shelf will protrude through a 45° or 90° corner door for accessibility and is recessed when the door is closed. The shelf may rest on a track forming a kinematic path for the rotation of the shelf such as around the inside periphery of the cabinet or may be mounted on a central post or other support means with a gear or rotor system of special design to facilitate turning.

30 Claims, 12 Drawing Sheets

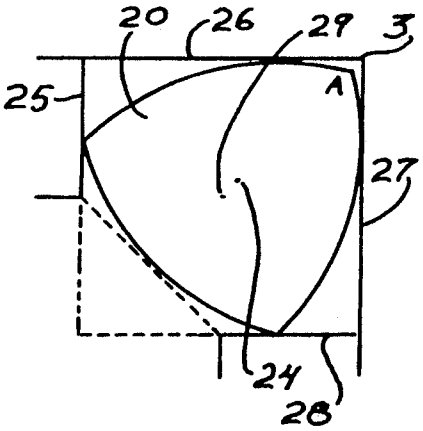
FIG 5A
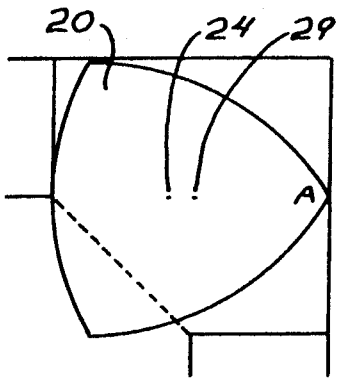
FIG 5B
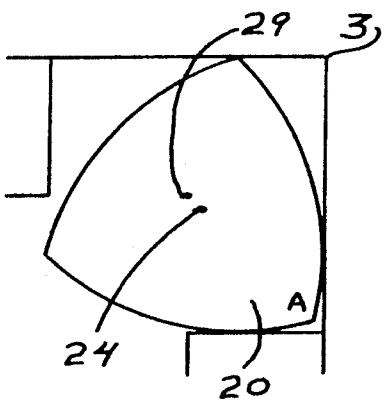
FIG 5C
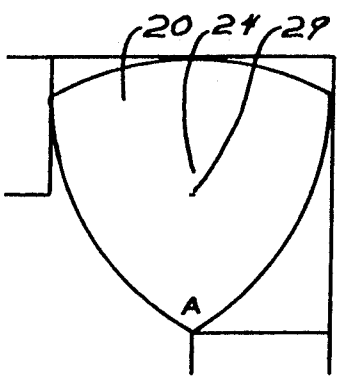
FIG 5D
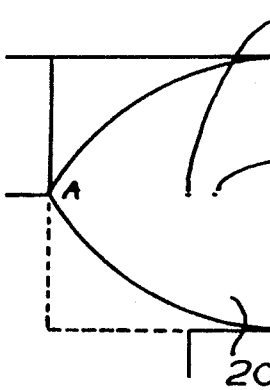
FIG 5E
FIG 5F
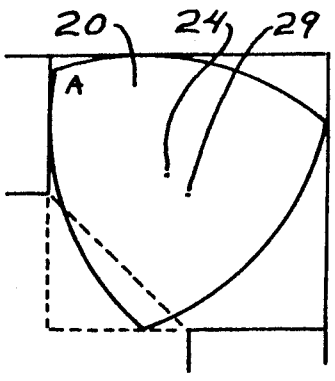
FIG 5G
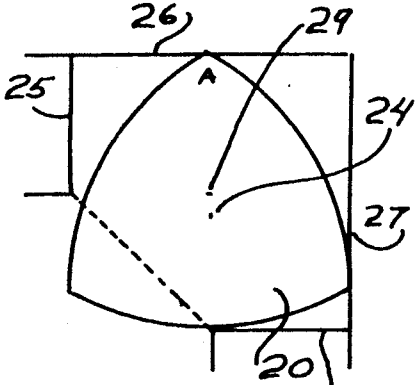
FIG 5H 24
29
121
123
126

CORNER CABINET

RELATED APPLICATION

This is a continuation-in-part of my U.S. Pat. Ser. No. 821,047 filed Jan. 22, 1986 now abandoned.

BACKGROUND OF THE INVENTION

The popularity of built-in kitchen counters and cabinets has created a common problem of how to provide accessibility to the corner space underneath the counter and/or in the wall cabinets which frequently are built on adjacent walls and meet in a corner. Typical prior art approaches to the problem of the corner cabinet involve the use of a circular shelf built on a pivot of one kind or another, often with a forty-five degree angle door or even a ninety-degree angle door placed on the inside corner of the cabinet face, the latter involving the cutting of a ninety-degree corner out of the shelf. Patents showing such structures are U.S. Pat. Nos. 2,239,734, 2,629,643, 2,693,401, 3,160,453, and 4,146,280. A lazy susan configuration which permits adjustment of the position of the rotating mechanism tends to have a particularly large number of parts—see U.S. Pat. No. 4,433,885.

Referring now to an art quite removed from the cabinet art, it is known to drill square holes utilizing a drill bit based on the geometry of curves of constant width, particularly the triangular curve of constant width sometimes referred to as the Reuleaux triangle. U.S. Pat. No. 4,074,778 describes such a drill bit and a gear mechanism to power it, in which cutting blades may be positioned at the apexes of a triangular curve of constant width. See also U.S. Pat. Nos. 4,012,077 and 4,062,595 which employ a related mechanism for coal mining. The reader may also be interested in early U.S. Pat. Nos. 1,241,175, 1,241,176, and 1,241,177, the article in Scientific American of February 1963, page 148, which is cited in the aforementioned U.S. Pat. No. 4,074,778, and the original and classic review of the properties of the curved triangle of constant width by Franz Reuleaux, entitled "The Kinematics of Machinery", Dover Publications Inc., New York 1963 pp 131 to 168, which was originally published in 1875. A typical illustration of a curve of constant width shows a triangular curve of constant width rotating within the confines of a square, always in contact with one point on each side of the square. See also Krayer and Hronas U.S. Pat. No. 3,369,320, which employs an "expansion" of the Reuleaux triangle.

Prior to the present invention, no one has applied the geometry of the Reuleaux triangle or any other closed curve of constant width other than a circle to the problem of the common corner cabinet, to my knowledge.

DESCRIPTION OF THE INVENTION

I have invented a design for corner cabinets which provides more convenient, greater accessibility and frequently more shelf space than has been possible in the past. My invention involves preferably the use of a shelf in the shape of a triangular curve of constant width, or Reuleaux triangle, which may be turned and supported in several different ways, but the shelf may assume the shape of any closed curve of constant width having more than one curve. When such a closed curve has an equilateral configuration it will typically have at least three arcs, as will be explained below. Most preferably, the cabinet will have a door at a forty-five degree [or one hundred thirty-five degree]angle with respect to the face of the wall cabinets next to it and which meet in a corner, or otherwise angled and placed so as to maximize the utilization of space within the confines of the cabinet.

The invention is best explained with reference to the drawings, of which FIG. 1 is a more or less diagrammatic overhead view of a corner space occupied by a typical prior art cabinet having a "lazy susan" type shelf and a 45° angle door, FIG. 2 is a similar view of another common prior art configuration having a 90° corner cut out of the lazy susan, and FIG. 3 is a more or less diagrammatic overhead view of a shelf of my preferred "Reuleaux triangle" design in a similar corner space. FIG. 4 is another more or less diagrammatic depiction of a different preferred configuration of my shelf and cabinet. FIGS. 5A to 5H depict schematically the various orientations of my preferred shelf as it turns in the cabinet. FIGS. 6A, 6B and 6C illustrate a peripheral edge support and runner which serves as a rotation guide for the shelf. FIG. 7 shows an alternative preferred arrangement of a "Reuleaux triangle" shelf and runners. FIG. 8 illustrates an internal gear arrangement also useful to guide the rotation of the shelf without using a track or runners. FIGS. 9, 10 and 11 are variations of the internal gear mechanism, FIG. 12 shows schematically the operation of a planetary gear assembly which will also permit the rotation of the Reuleaux triangle shelf without the use of tracks or runners; FIGS. 13A to 13H show diagrammatically the gears of FIG. 12 throughout the sequence of positions of the shelf in FIGS. 5A–5H. FIG. 14A–14D illustrate the utility of a shelf in the shape of a rounded regular pentagon. FIG. 15 shows a shelf in the shape of an irregular 7-sided closed curve of constant width, and FIG. 16 is an irregular 5-sided configuration showing a possible offset door for adjoining cabinets of different depths. 17 shows yet another guiding system for the Reuleaux triangle, this one being an adaptation of the "centroid" described by Franz Reuleaux; FIG. 18 illustrates an advantageous use of the "centroid" system with a cutout in the shelf. FIG. 19 shows a ring guidance system for a post or shaft, along with upright bearings for support of the shelf.

DETAILED DESCRIPTION OF THE DRAWINGS

Figure 1:
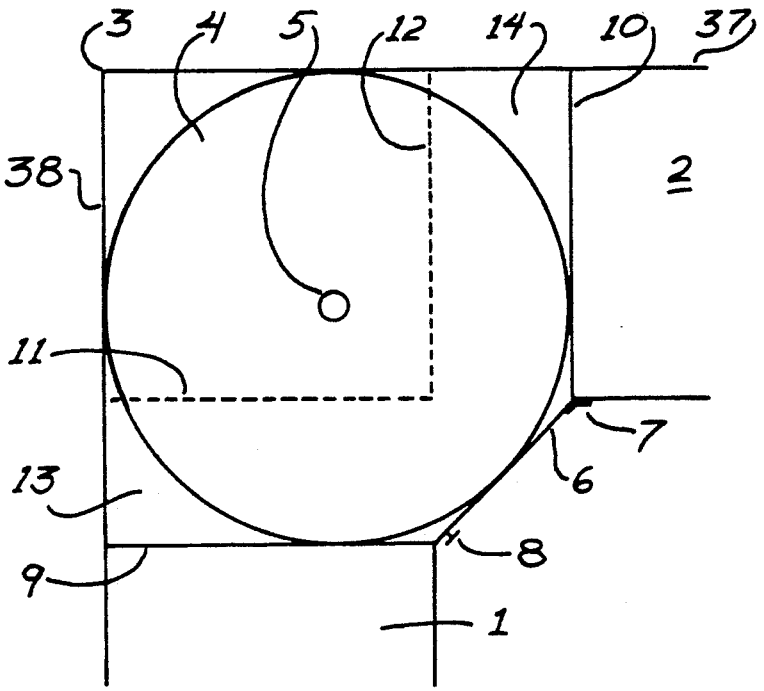
FIG 1 PRIOR ART

Referring now to FIG. 1, wall cabinets 1 and 2 meet at corner 3, which has been equipped with a typical prior art circular shelf 4 mounted on a post 5 on which it may rotate within the corner cabinet under a countertop not shown. This prior art configuration has a door 6 on hinges 7, which may be opened by handle 8. The owner opens the door and rotates the shelf to obtain access to articles residing on areas of the shelf 4 not otherwise immediately accessible to the door 6. It will be noted that efficiency of the use of space requires that internal walls 9 and 10 should be adjacent to the circular shelf 4 and that the size of the door 6 is limited by the positions of internal walls 9 and 10 and the diameter of the shelf 4. That is, if the door 6, internal walls 9 and 10 and the back walls 37 and 38 are all to be tangent to the shelf 4, and the the depth of internal walls 9 and 10 is predetermined, then the size (diameter) of the shelf 4 is fixed and the length of door 6 is also fixed. The most obvious constraint on the design is the depth of the cabinets, i.e. the length of internal walls 9 and 10. Given a cabinet depth of, say, two feet (about 60.1 centimeters), a shelf positioned as in FIG. 1 must occupy a space greater than two feet square in order to provide access from the internal corner; the shelf 4 of FIG. 1 occupies significant portions of back walls 37 and 38 even though door 6 is not particularly wide. Bearing in mind that the purpose of the cabinet is to utilize a space having an area of the square of internal walls 9 and 10, i.e. as shown by the dotted lines 11 and 12, it will be seen that the design has in effect sacrificed some of the space 13 and 14 which would have been accessible from wall cabinets 1 and 2, in order to utilize only a portion of the space in the corner defined by dotted lines 11 and 12 and back walls 37 and 38.

Figure 2:
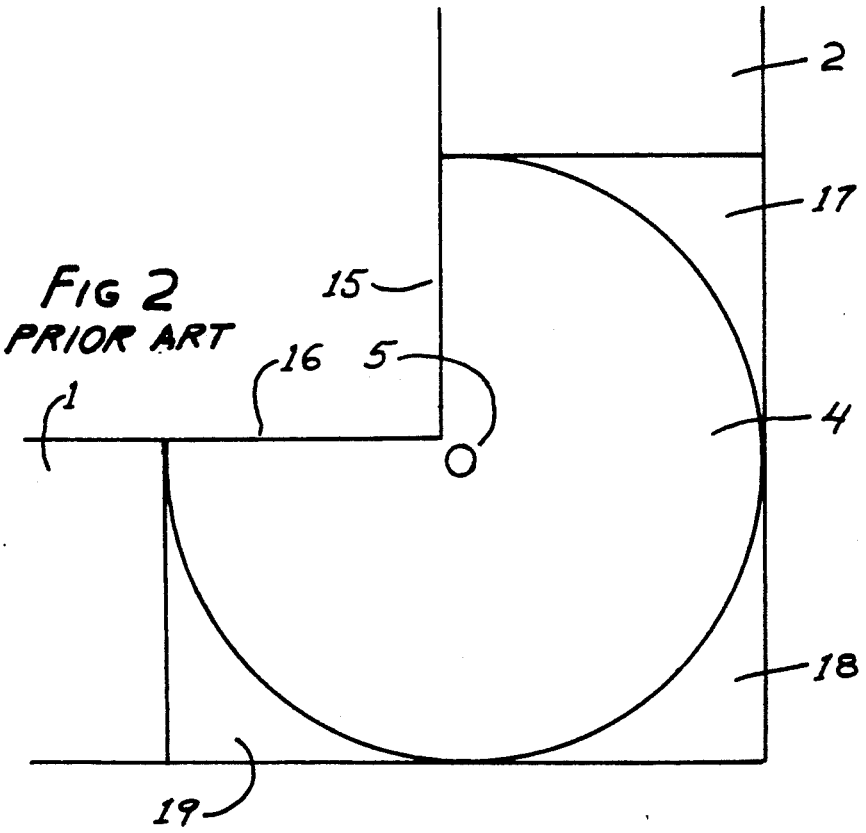
FIG 2 PRIOR ART

Referring now to FIG. 2, a slightly different more or less diagrammatic depiction of the typical prior art approach shows wall cabinets 1 and 2 and circular shelf 4 designed to blend into the faces of wall cabinets 1 and 2 to form a 90° corner instead of a 45°(or 135°) face as in FIG. 1. In this prior art design, an angular door 16 is attached to the cut-out shelf 4 in such a way as to rotate with shelf 4 on pivot 5. Disadvantages of this design include the obvious sacrifice of shelf space by the cut-out 15 while also sacrificing spaces 17, 18, and 19. Moreover, it will be observed that, while the depth of the cabinets is the same as in FIG. 1, the diameter of the shelf is shown to be larger than in FIG. 1 relative to the depth of the wall cabinets in conformity with the more typical commercial configuration of the "lazy susan" corner shelf. Spaces 17 and 19 are larger than spaces 13 and 14 in FIG. 1, and the cut-out area 15 of shelf 4 approaches one-fourth of the circular area of shelf 4.

Figure 3:
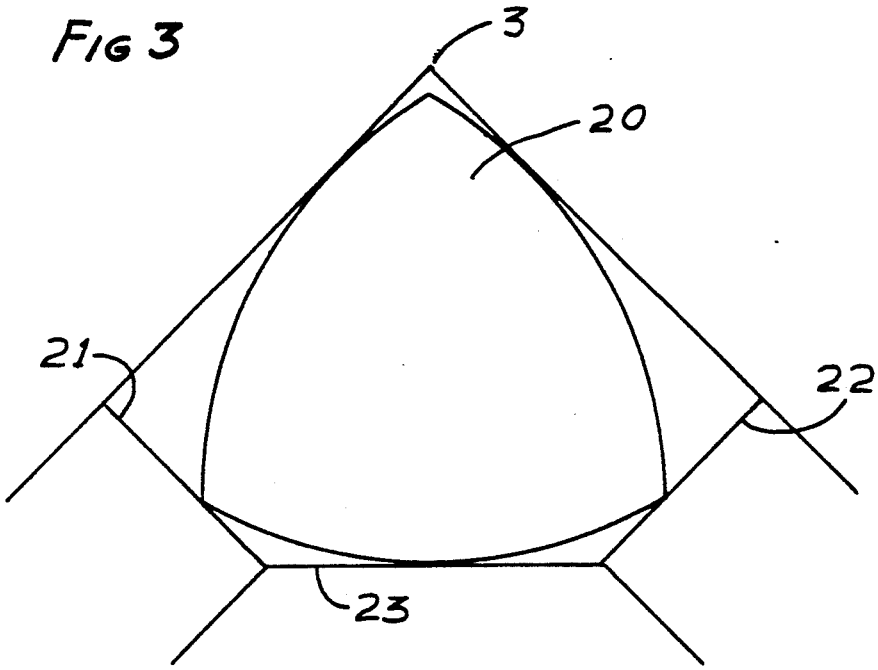

FIG. 3 depicts a preferred conceptual design of the present invention wherein the shelf 20 has the shape of a Reuleaux triangle. Such a figure may be drawn with a compass by placing the point of the compass on each of the corners of an equilateral triangle and drawing arcs joining the other two corners. As is shown in prior art references, this geometric figure will rotate within a square of the same constant dimension, at all times contacting all four sides of the square. FIG. 3 illustrates that, where internal walls 21 and 22 form the confines of shelf 20, i.e. are in contact with it, and the shelf is oriented as shown with one of its apexes pointed toward corner 3, a door 23 may be placed at a 45° angle to the faces of cabinets 1 and 2 as in FIG. 1. It should be observed that, while the Reuleaux triangle of a given width has a slightly smaller area than a circle of the same diameter (0.7048/0.7854 for a width and diameter of 1.0), the shallower curve of shelf 20 near door 23 permits more area of the shelf 20 to be immediately accessible from the door without turning the shelf than is the case with a circle, whose curve is determined as an arc drawn from the center of the circle rather than from the apex of an equilateral triangle as is the configuration of FIG. 3. The reader may also observe that, because of the curvature of the edge of the shelf 20, a wider door 23 may be utilized, if desired, than is the case with a circular shelf of the same width or diameter. The space occupied by the corner cabinet is thus more efficiently utilized than is the case with a circular shelf, even while the shelf is at rest.

Figure 4:
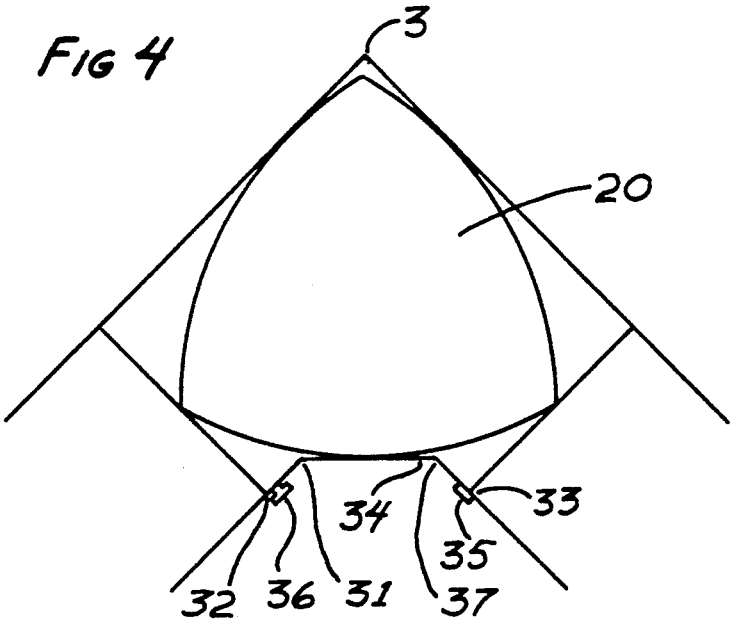

FIG. 4 shows conceptually a slightly different preferred cabinet and door configuration for cabinets the same depth as those in FIG. 3. In this case, it will be seen that the door 34 extends between points 32 and 33, but it includes two 45° angles at 31 and 37 in order to decrease the distance from the face of the door 34 to corner 3 as compared to the configuration of FIG. 3. In this case, the door is mounted on hinges 35 and is opened by handle 36. The use of a door 34 of the shape shown enables a smaller shelf 20 to be used relative to the depth of the cabinets, i.e. less of the building wall space is used than in FIG. 3.

The shelf 20 is even more accessible when rotated, as can be seen from FIGS. 5A to 5H. In FIGS. 5A to 5H, the progress of apex A of the shelf 20 as it turns clockwise around the square may be compared to the position of point 24, the center of the shelf 20, with respect to the center 29 of the square defined by walls 25, 26, 27, and 28. It should be observed that, when apex A is oriented to protrude from the cabinet as in FIG. 5E, center 24 of the Reuleaux triangle is also at its greatest distance from the corner 3. In FIG. 5E, almost the entire area of the lower left quadrant of the square in which the Reuleaux triangle shelf turns is occupied by the shelf. A very large portion of the shelf is thus highly conveniently and easily accessible. The square area in which the shelf 20 resides, including the portion of it not actually drawn, into which apex A protrudes in FIG. 5E, may be said to be substantially peripherally tangent to said shelf, since a Reuleaux triangle (or any other closed curve of constant width) which turns in a square area is always in contact with it at one point on each side of the square. The reader may also observe that while apex A moves clockwise from corner to corner of the square, point 24 revolves counterclockwise around point 29 at the rate of 135° for each 45 degrees moved by apex A. For a Reuleaux triangle as shown in FIGS. 5A through 5H having a height 1 which fits into a square of sides 1, the distance from the center of the square to the center of the Reuleaux triangle (the intersection of the bisectors of the corner angles) is constant as the center of the triangle revolves around the center of the square, at a distance of about 0.0773. In the course of travel of apex A around the periphery of the square, the center of the triangle revolves around the center of the square three times for each full 360° turn of apex A and for each rotation of the center. Rotation of the center of the Reuleaux triangle is in a clockwise direction; however, at the same time it revolves counterclockwise, as mentioned above.

Figure 6C:
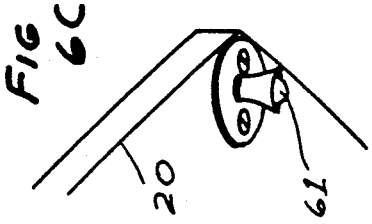
Figure 6B:
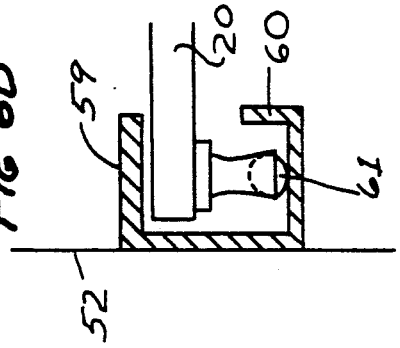
Figure 6A:
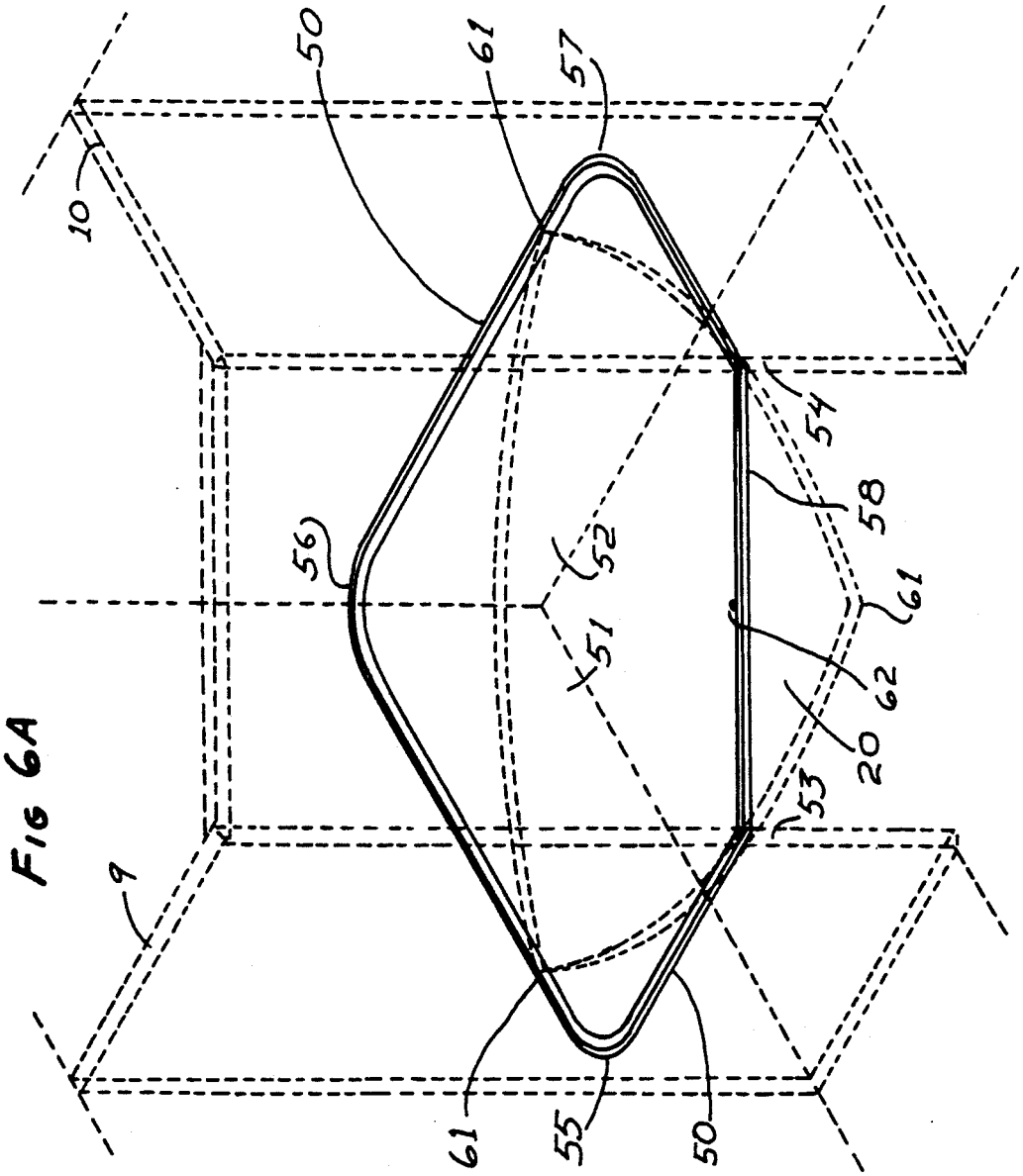

In FIG. 6A, the shelf 20 is supported by a runner 50 attached to walls 9, 10, 51 and 52, preferably extending almost the full lengths of the walls 9, 10, 51 and 52 beginning at door jamb 53 and terminating at door jamb 54. It should be noted that the corners 55, 56, and 57 of the runners are slightly rounded rather than square to accommodate the fact that an apex of the triangle will not extend the entire distance into a corner of the cabinet, as may be seen clearly in FIGS. 5A and 5C. The runners should have means for restraining inward movement of the shelf and thus may be made of C-shaped extrusions or preferably of a shape shown in FIG. 6B. In FIG. 6B, the upwardly-extending flange 60 of the runner 50 provides sufficient guidance for a friction-reducing bearing or contact point such as ball 61 to prevent inward movement of the shelf 20 particularly in the configuration of FIG. 6A when one of the apexes is protruding from the door, i.e. when one of the contact points is not in a runner. Further support for the shelf 20 is advantageously provided by cross-piece 58 which is shown to extend from door jamb 53 to door jamb 54 While it is preferred that the runners 50 should have an upward movement shelf restricting means such as lip 59 a similar upward movement restraining means is not recommended for cross-piece 58, since it would interfere with the placement of objects stored on shelf 20 and complicate the free movement of the apexes of the shelf into the position of FIG. 5E. Any of numerous friction-reducing means may be employed on the runners 50 and/or the portions of the shelf 20 which come into contact with it, such as the nylon or delrin molded balls 61 on each of the apexes of shelf 20 and as illustrated in FIG. 6C and one such ball 62 mounted upwardly on cross-piece 58. It will be noted from FIGS. 5A to 5H that when a Reuleaux triangle turns in a square, the apexes remain in contact with the square except at the corners of the square as previously explained. Thus the three balls on the apexes are sufficient for the runner configuration of FIG. 6A, provided that, preferably, a ball should also be mounted on the cross-piece 58 so that, when one of the apexes is disengaged from the runners, i.e. Protrudes from the door, a smooth shelf motion is provided on an effective, continuous support.

Since, as indicated above, the runners will normally terminate at the door jambs 53 and 54 as shown, they should be designed to permit a smooth entrance by the ball under the apex which protrudes. For this purpose it is recommended that the retaining lips 60 of the runners should diverge slightly at their termination near door jambs 53 and 54.

Other variations of the runners may be employed to support the shelf. For example, several runners with balls or other friction-reducing bearings on top as on the cross-piece 58 could be placed in various directions so as to provide at all times at least 3 or 4 bearings in contact with the shelf to provide stability. However, guide means should be provided to retain the shelf in its designated square area and/or otherwise to prevent the shelf from "floating" particularly when an apex protrudes through the door. The guide means may describe the kinematic path of any point on the triangle, as will be discussed below. One may utilize the fact that the motion of the midpoint of a side of the Reuleaux triangle will describe a fixed pattern more or less diagonal to the sides of the square cabinet. That is, runners may be positioned in the form of a curved square with its corners at the midpoints of back walls 51 and 52 and on or near the door jambs 53 and 54.

Figure 7:
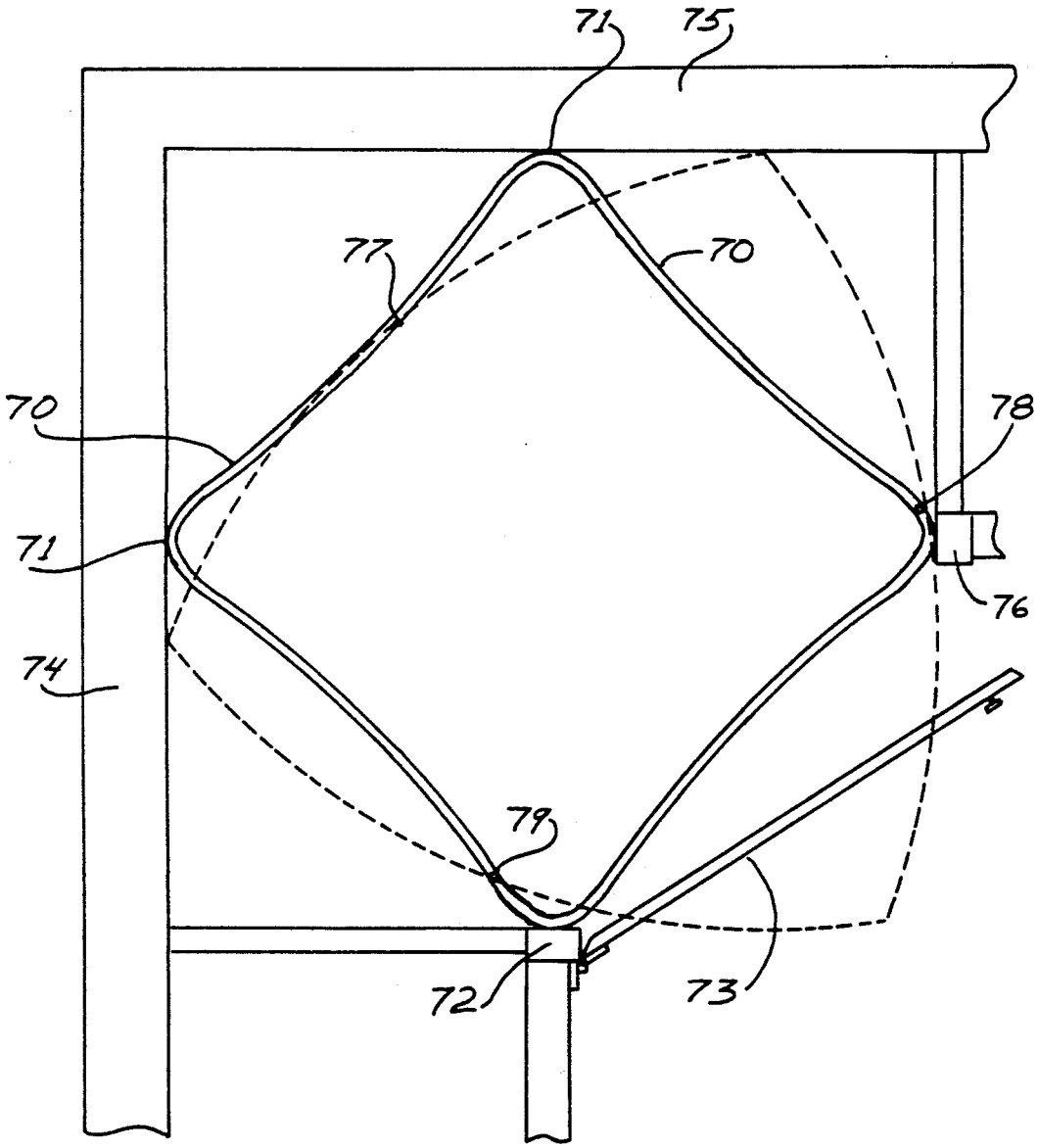

FIG. 7 is an overhead view of the disposition of runners 70 in the form of such a curved square connecting the centers 71 of the back walls 74 and 75, and door frame sides 72 and 76 for door 73. The point at which the runner connects on the door frame is at the center of the side of the square inhabited by the Reuleaux triangle. Thus placed, the runners will accommodate the kinematic path of the points at the centers of the arcs of the Reuleaux triangle; in a preferred variation of my invention, 1 therefore place balls or other friction-reducing contact or support means on the centers of the arcs (points 77, 78, and 79) and place them on the runners thus mounted by means of brackets in the corner cabinet. The runners should form a curved square having the configuration shown so long as the contact points are on the shelf at the positions of 77, 78, and 79, i.e. in the middle of each arc edge. If the contact points are set in slightly from the edge, the square will become more inwardly distorted and the runners should be more curved. While this and many of the other infinite number of kinematic patterns which could be followed are more difficult to make than a substantially square track of the type shown in FIG. 6A, I prefer to use the curved square rather than the straight one because it is smaller and does not require that the bearings depart from the track at the door as does the track of FIG. 6A. It should be understood, however, that any patterns of runners or other friction-reducing supports may be used so long as they permit the shelf to be turned in the Reuleaux triangle pattern within the square into which it fits. There is an infinite number of patterns which may be used, as will be seen by reference to Franz Reuleaux's book mentioned in the Background of the Invention. The rotation of the Reuleaux triangle within the square area may also be accomplished through the use of gears. For example, as indicated in U.S. Pat. No. 4,074,778, an internal gear set in a ratio of 4:3 will provide the kind of hypocycloid motion required. As applied to the shelf, the center of the moving (internal) gear may be mounted on the center of the shelf while the center of the square is fixed on the center of the other (ring) gear.

Figure 8:
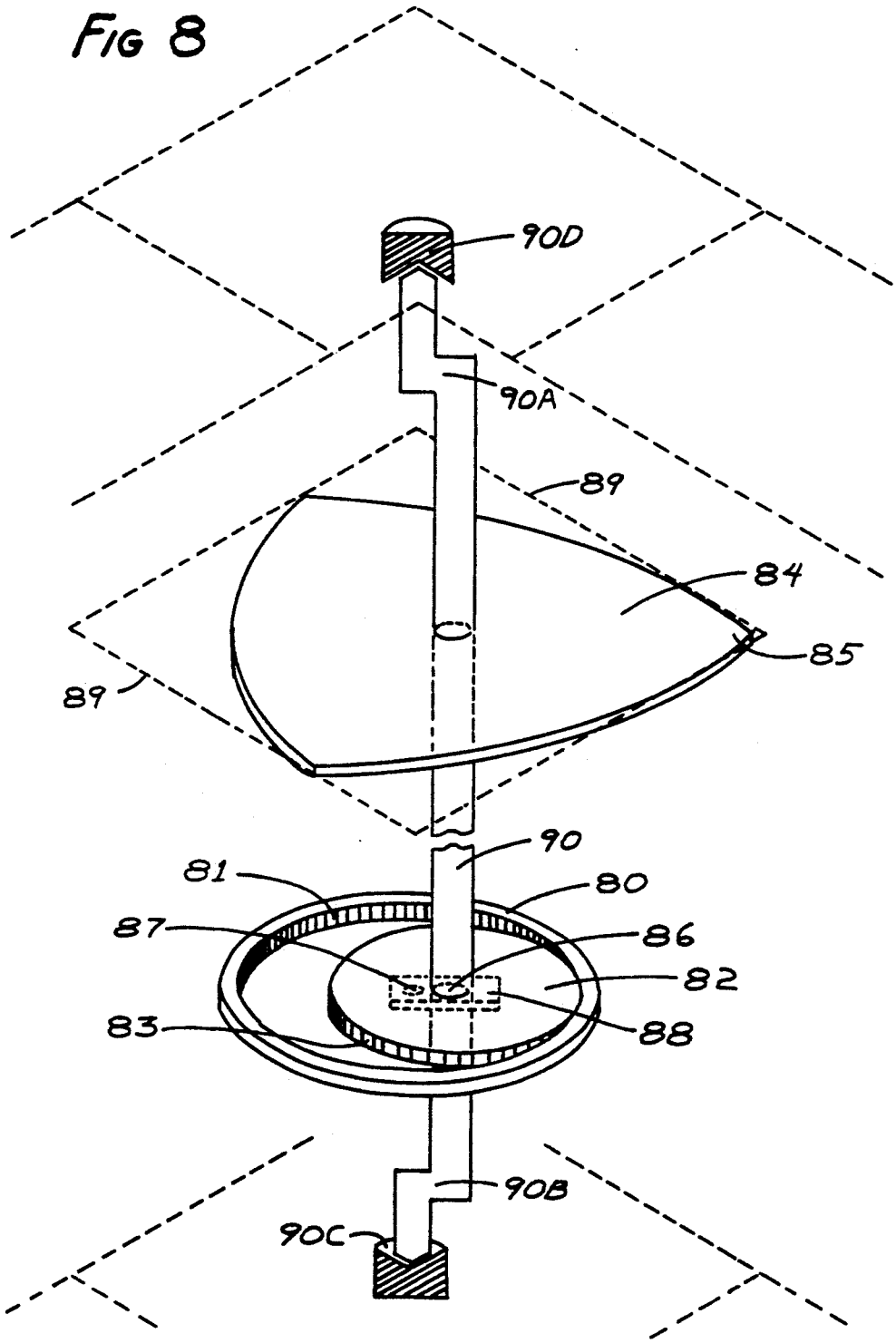

In FIG. 8, a shelf mechanism is shown having a rotation guiding means comprising a ring gear 80 with internal teeth 81 and an internal gear 82 having external teeth 83. The shelf 84 is fixed to the internal gear 82 by means of shaft 90 so that it will be turned as the internal gear turns. Internal gear 82 and ring gear 80 may be in any plane parallel to the plane of shelf 84; in one preferred embodiment, the internal gear is flush against shelf 84 and in fact may be manufactured as an integral part of it. The ratio of the effective diameter of ring gear 80 and internal gear 82 is 4:3, and the number of gear teeth 81 and 83 is also in a ratio of 4:3. The assembly is placed so that apex 85 of shelf 84 is aligned with the center 86 of internal gear 82 and center 87 of ring gear 80. Center 87 of ring gear 80 is aligned vertically with the center of the square 89 in which the shelf 84 is to turn, as illustrated in FIG. 5, i.e. the center 87 of ring gear 80 is located at a point equivalent to point 29 of FIG. 5. Thus, alignment of apex 85 with centers 86 and 87 as shown is equivalent to the alignment of apex A and points 24 and 29 in FIG. 5E. The distance between centers 86 and 87 is, as explained above, to be maintained at about 7.73% of the width of the shelf; this may be accomplished by the use of link 88 which is free to turn at both centers 86 and 87 while center point 86 revolves around center point 87. As the user turns shelf 84, it is made to stay in the desired cabinet square area shown by dotted line 89, by the rotation of internal gear 82 to which it is fixed. Link 88 may be fixed to post 90 for support to a base. Post 90 has turns 90A and 90B in order to be aligned with centers 86 and 87. The bottom of post 90 rests in bearing surface 90C, which may be anchored on the floor, and the top of post 90 is free to turn in mounting unit 90D which may be attached to the underside of a countertop.

It should be observed that, since the center of the shelf and the center of the square area are a distance apart 0.0773 of the width of the square and shelf, and the gears are in a 4:3 ratio, the ring gear therefore has an effective diameter 0.6184 of the shelf's width, and the internal gear's diameter is 0.4638 of the shelf's width. As mentioned in U.S. Pat. No. 4,074,778, the distance between centers 86 and 87 is one-eighth of the diameter of ring gear 80.

Figure 9:
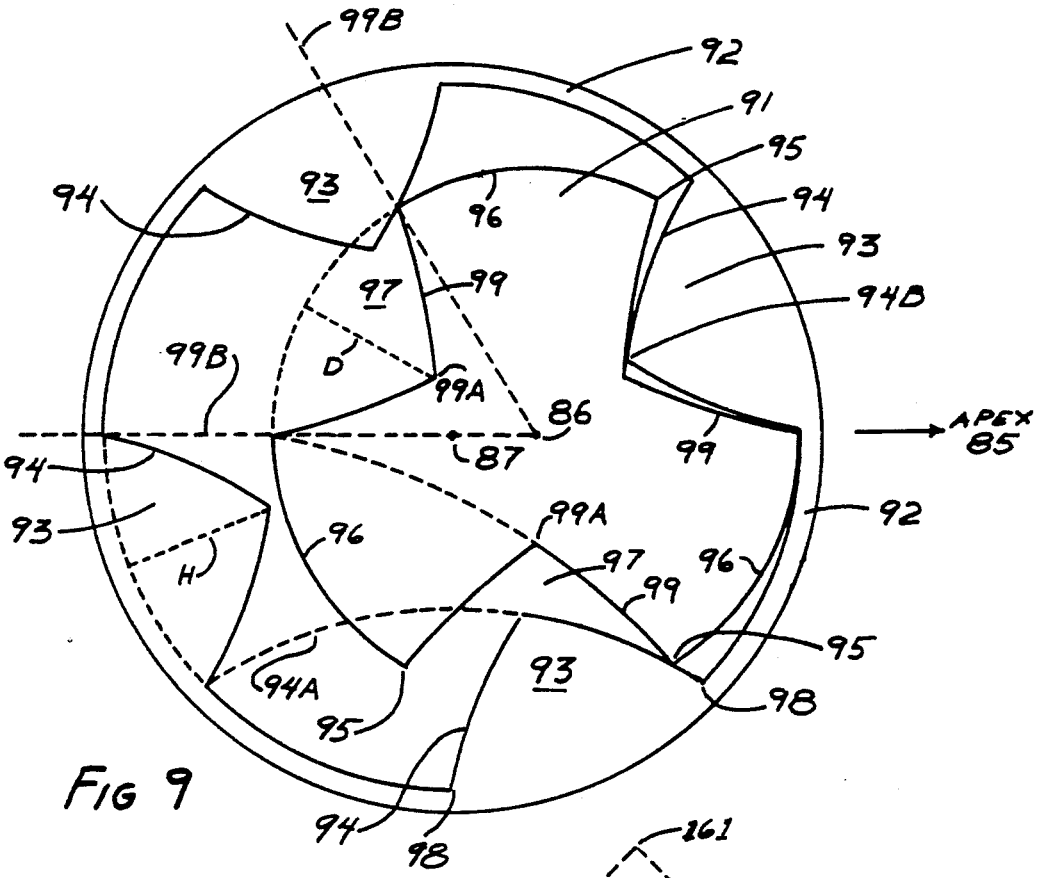

FIG. 9 illustrates a variation of the 4:3 internal gear arrangement of FIG. 8 which does not require a link. It is a more or less diagrammatic overhead view of a modified ring gear and internal gear, now called a gear-rotor, of the same relative dimensions and effective motion as those of FIG. 8. The shapes of the two gears are such that the center 86 of gear-rotor 91 revolves around center 87 of ring gear 92 without any direct connection such as link 88 in FIG. 8. It will be seen that ring gear 92 now has but four teeth 93, which are of a particular shape, having profiles 94 which lie on the hypocycloid arcs 94A followed by the corners 95 of the gear-rotor 91 as the gear-rotor 91 rotates within the ring gear 92. These arcs 94A are the same type of path followed by any point on the perimeter of the internal gear 82 in FIG. 8 as it turns in the ring gear 80. Gear-rotor 91 may be seen to have three portions or teeth having the same perimeter curvatures 96 as the internal gear 82 of FIG. 8. That is, the proportions of ring gear 92 and gear-rotor 91 of FIG. 9 are the same as in FIG. 8; likewise the number of "teeth" (curved portions 96) in the respective gears has the same 4:3 ratio, since the gear-rotor 91 has three cut-out portions 97. The corners 95 of gear-rotor 91 are 60 degrees apart, while the corners 98 of the ring gear 92 are 45 degrees apart with respect to ring gear 92, yet the curved distances between corners on the respective outside perimeters are the same. FIG. 9 shows gear-rotor 91 oriented in the same direction as the internal gear 82 of FIG. 8., as may be seen by the arrow indicating the direction of apex 85.

It should be observed that, while curved profiles 94 of ring gear 92 have the same curvatures as the hypocycloid path followed by any point on the perimeter curvature 96, the apexes of their profiles at 94B have the same height H as the depth D of apexes 99A of profiles 99 on the gear rotor 91. Thus profile 99 is an arc having a radius originating on line 99B, for example, at a distance such that two such arcs drawn from lines 99B 60 degrees apart will intersect at a point the distance D from the perimeter of a circle following perimeter curvature 96. For a shelf of width 1.0, the radius will be about 0.592. Line 99B is an extension of a line drawn through center 86 and corner 95. Since the corners 95 always move only on the hypocycloid arcs 94 and 94A, gear-rotor 91 is constrained at all times to the same rotation pattern as ring gear 82 of FIG. 8 without the need for a linkage.

Figure 10:
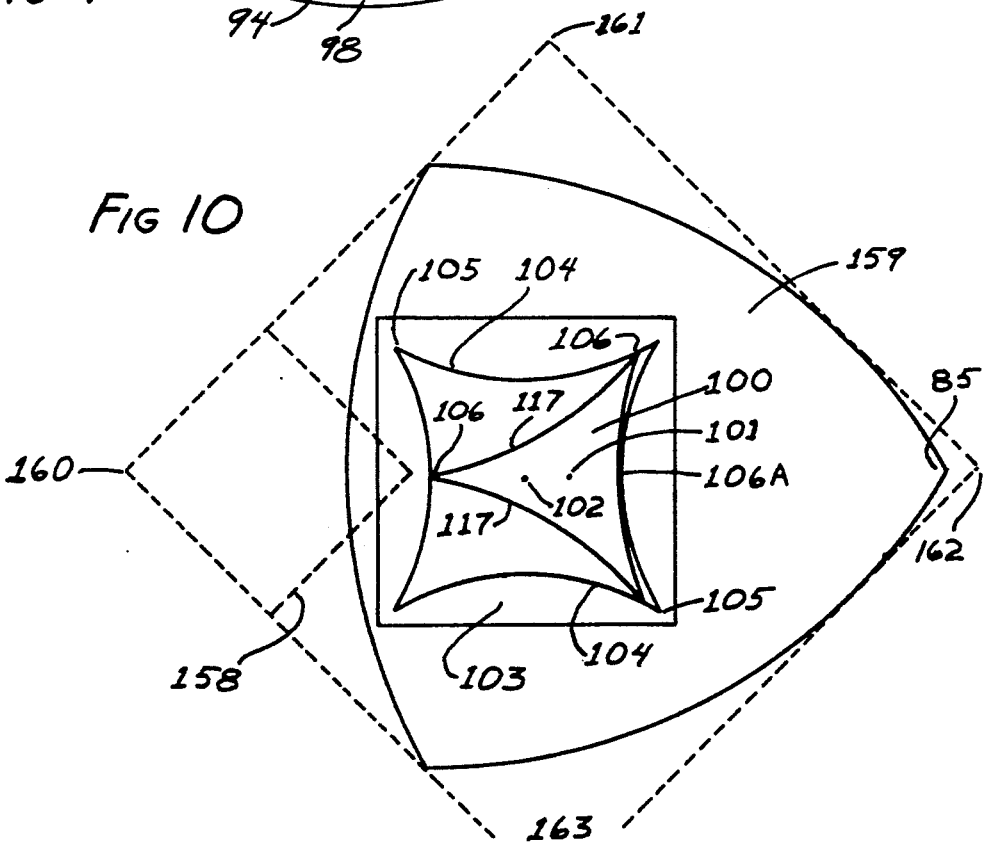

In FIG. 10, I have illustrated diagrammatically yet another variation of the 4:3 internal gear set. As with any gear-type guide mechanism such as the one in FIG. 9 and FIG. 11 as well, the concave triangular gear rotor 100 which is fixed to or part of the shelf 159 will permanently determine the position of the shelf 159 with respect to the square 160-161-162-163 in which it rotates. Thus, for example, if center 101 of the gear-rotor 100 and center 102 of the square 160-161-162-163 are aligned as shown and apex 85 is in the direction shown, say, in a position to project from the cabinet as in FIG. 5E, then it will always project from that orientation after numerous rotations while gear-rotor 100 is confined in cam 103. Cam 103 has four curved surfaces 104 in the form of a concave square, the corners 105 lying on the effective perimeter of teeth 81 in FIG. 8. Surfaces 104 are shaped as equal arcs drawn on the path followed by a point on the perimeter of gear-rotor 91, or the internal gear 82 or, in this case, the points 106 of gear-rotor 100, as the internal gear 82 or its equivalent rotor turns inside the ring gear 80. In this case, the cam 103 is equivalent to the ring gear 80 in FIG. 8, having just four "teeth", i.e. curved cam surfaces 104. Points 106 of gear-rotor 100 will always be in contact with cam surfaces 104 and/or in corners 105 of cam 103, since they follow the hypocycloid function of points on the perimeter of the internal gear [gear rotor 100] as it turns in the inside of the ring gear [cam 103]. The curvature of profiles 117 is the same as that of arcuate surfaces 99 in FIG. 9 while the curvature of surfaces 104 is the same as that of profiles 94. A linkage between centers 101 and 102 is not needed because gear-rotor 100 is always in contact with all four cam surfaces 104, at points 106 and at a "rolling" point 106A which will change as the gear-rotor 100 moves.

The fact that cam 103 has concave sides is used advantageously where it is desired to have a 90° inside corner such as corner 158. Following the practice of the prior art with respect to circular shelves, a piece of the shelf 159 may be cut out to conform to the profile of corner 158 when shelf 159 is recessed as shown. While this configuration requires that the shelf 159 always be returned to the position shown to be re-oriented with corner 158, the area of shelf space sacrificed by the cut-out is not nearly as large as it would be with a circular shelf. The reader will observe that my FIG. 9 and 11 guidance mechanisms are also particularly adaptive to a 90° inside corner such as corner 158. In the FIG. 9 configuration, the shelf should be initially oriented so that apex 85 is in line with one of the apexes 99A as well as centers 86 and 87 The inside corner such as 158 in FIG. 10 may than protrude into one of the teeth 93 of ring gear 92 in FIG. 9; the distance it is able to protrude will be somewhat greater then that of the protrusion of FIG. 10

Figure 11:
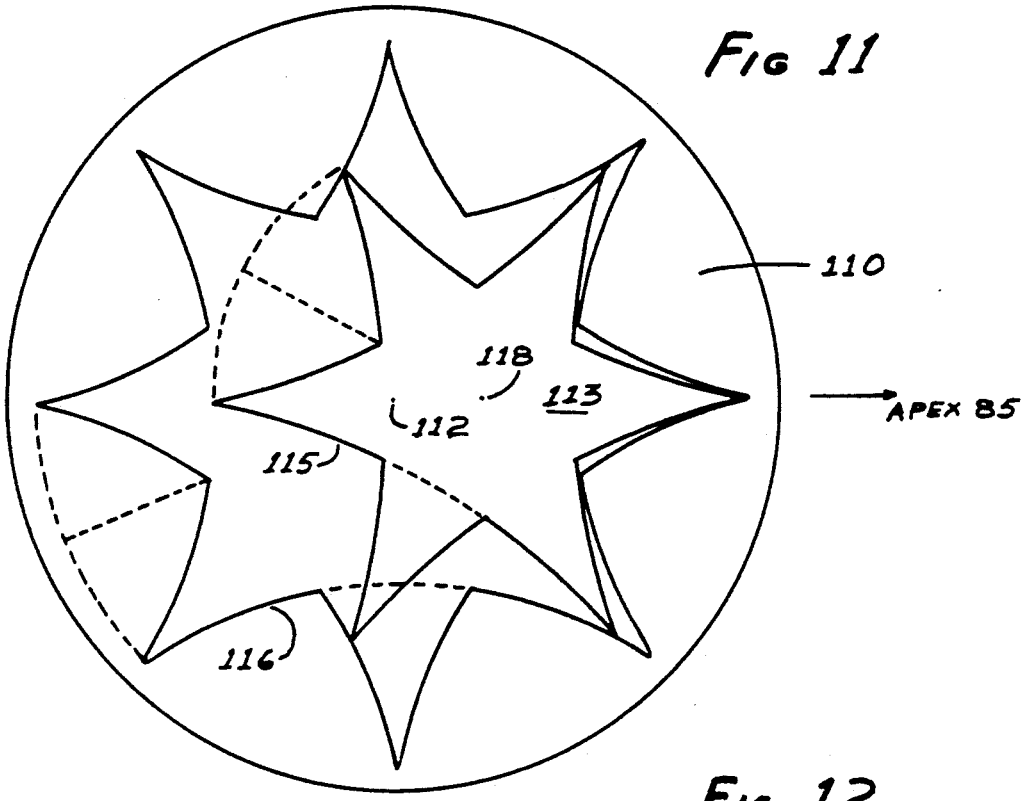

FIG. 11 diagrammatically another variation of the 4:3 internal gear. Cam 110 is permanently placed within the cabinet with its center 112 in the center of the designated square area within which the shelf will rotate. The shelf (not shown) with gear rotor 113 attached underneath is then placed on top of the cam 110, the gear-rotor 113 fitting within the cam as shown. As with the other designs based on the internal gear set, care should be taken in the initial placement to orient one of the shelf apexes toward a corner of the designated square area. Otherwise the square perimeter followed by the apex will be skewed from the desired square perimeter. It may be observed that the outlines of gear-rotor 113 and cam 110 are the equivalent of two superimposed outlines of gear-rotor 100 and cam 103 of FIG. 10. The curvatures of arcs 115 of gear-rotor 113 and of arcs 116 of cam 110 are in fact the same as the concave triangle profiles 117 and the sides 104 of cam 103. Thus, like the configuration of FIG. 10, the embodiment of FIG. 11 is equivalent to the 4:3 gear-rotor system of FIG. 8 except that, like the design of FIGS. 9 and 10, the FIG. 11 design does not require a link between the center 112 of the square and center 118 of the gear-rotor 113 because cam 110 at all times restrains motion in any direction except one in which the shelf will be confined in the designated square area.

Any of my linkless guiding means such as illustrated in FIGS. 9, 10, and 11 may be considered to have cams (as modified ring gears) and cam followers (as modified internal gears), also called herein gear-rotors.

Persons skilled in the gear art will recognize that, since, as mentioned above, the distance between the center of the square and the center of the triangle is about 7.73 percent of the width of the shelf (the sides of the square within which it rotates) the dimensions of internal gears and rotors in a fixed ratio will be determined by the size of the shelf e.g. a ratio of 4:3, the effective diameter of the ring gear being eight times the distance between the center of the square and the center of the triangle, which in turn will he determined by the designer's choice of the depth of the cabinets and the type and dimensions of the access through the inside corner adjoining cabinets.

Figure 12:
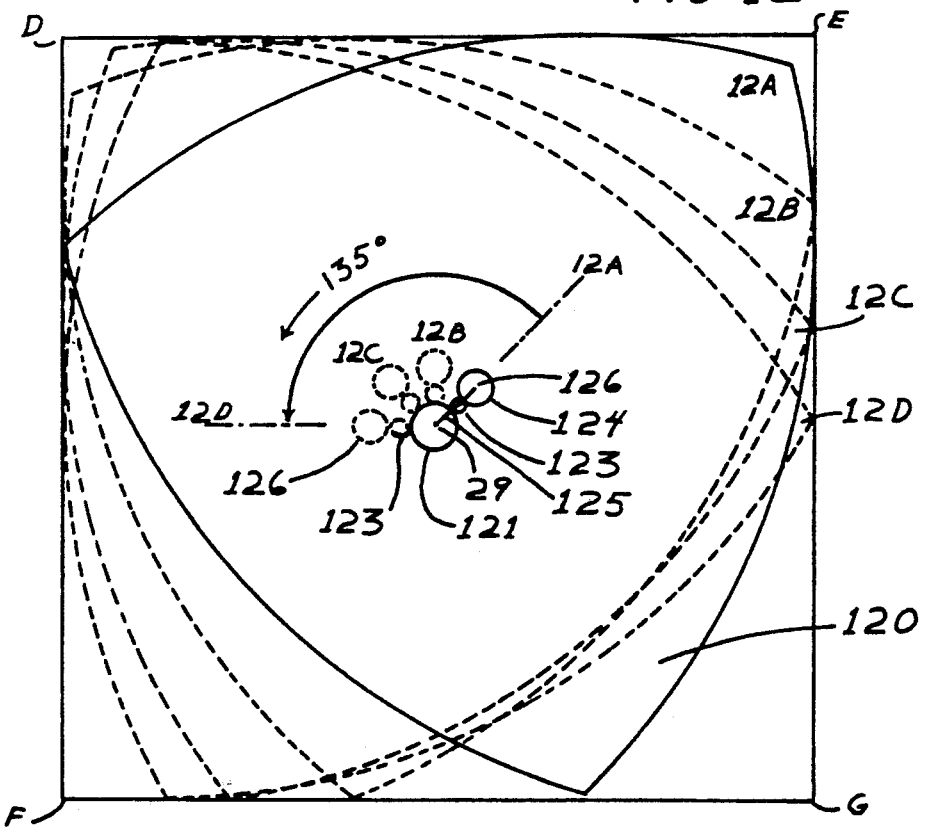

FIG. 12 presents diagrammatically the progress of a moving shelf 120 with the guidance of a planetary gear train. In FIG. 12, the central or "sun" gear 121 has a center 29 and is fixed, so that it cannot turn, at the center of square DEFG. Apex 12A of shelf 120 initially projects into corner E and accordingly the two planetary gears 123 and 124 lie in the direction of apex 12A. The center 126 of the large planetary gear 124 is located at the center of shelf 120 and is fixed to it so the shelf 120 will turn and travel wherever the gear 124 turns and travels. The gears 121, 123 and 124 are connected by a yoke 125 illustrated by a single line. The connection of the yoke at gear center 126 enables the gear 124 and shelf 120 to turn together with respect to the yoke 125. As the shelf 120 is moved by moving apex 12A clockwise, the gear 126 which is attached to it exerts a clockwise leverage on gear 123, which causes gear 123 to rotate counterclockwise while gear 126 and shelf 120 rotate clockwise. The counterclockwise rotation of gear 123 causes the revolution of the planetary train, held in alignment by the yoke 125, in a counter clockwise direction, permitting apex 12A to move in a straight line from E to G except for the slightly rounded corners. If the user exerts leverage in a somewhat different manner, as to encourage the revolution of the yoke 125 in the first instance, the rotation of gear 126 will follow to keep the shelf in its appropriate path of movement. The diameters and perimeters of the gears have a ratio of 8:3:6; accordingly, since the yoke 125 is free to move around center 29, which is fixed at the center of square DEFG, the center 126 of shelf 120 will revolve three times around center 29 for each rotation in the opposite direction. Thus, positions 12A to 12D of the gear train and the shelf apex depict the movement of the shelf between FIGS. 5A and 5B, position 12A being equivalent to FIG. 5A and position 12D corresponding to FIG. 5B.

Figures 13A, 13B, 13C, 13D, 13E, 13F, 13G, 13H:
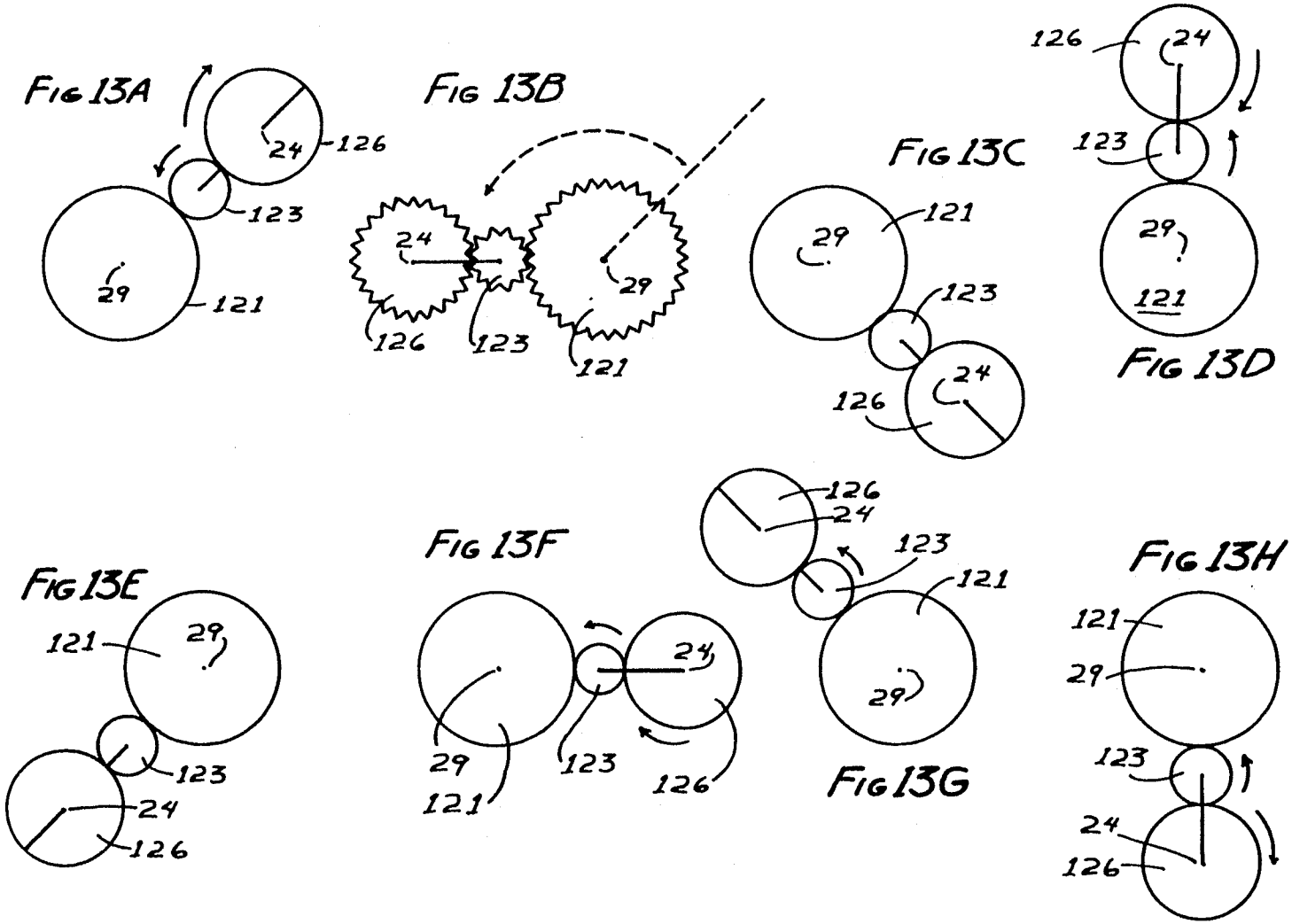
Figure 14A:
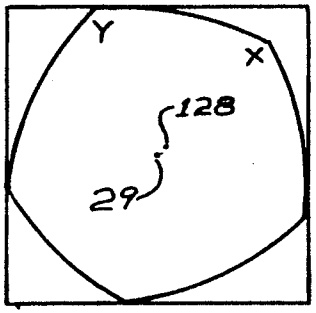
Figure 14B:
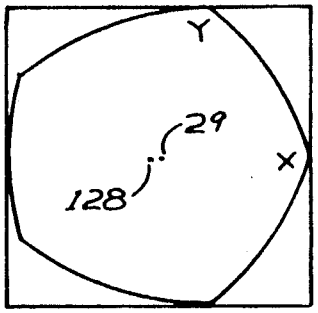
Figure 14C:
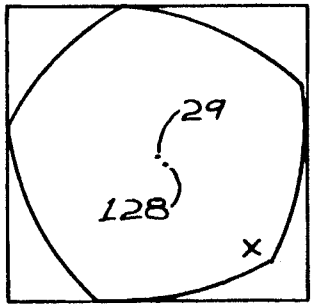
Figure 14D:
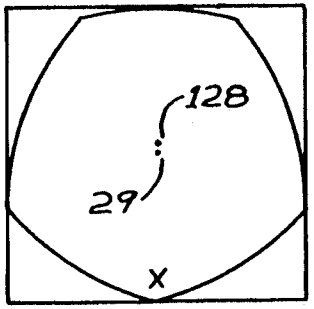

In FIGS. 13A to 13H, the gears 121, 123 and 126 have been marked to show their rotation; FIG. 13A to 13H correspond to FIGS. 5A to 5H, respectively. The gear teeth are illustrated in FIG. 13B only; it will be seen that in this configuration, stationary sun gear 121 has 32 teeth, planetary gear 123 has twelve teeth, and planetary gear 126 has twenty-four teeth. Gear 126 being fixed to the shelf, a movement from the orientation of FIG. 5A to that of FIG. 5B will revolve the two planetary gears 135°. An additional 135° will result in the correspondence of FIG. 5C and 13C, and so forth. It should be observed that, since the center points 29 and 24 are a distance apart 0.0773 of the width of the shelf, and the gears are in a ratio of 8:3:6, the sun gear 121 will have a diameter of about 0.062 and the other gears will have diameters fixed ac to the ratio 8:3:6.

Referring now to FIG. 14, the partial rotation of a regular rounded pentagon within a square is illustrated diagrammatically. As with the Reuleaux triangle in FIG. 5, the center 128 of the rounded pentagon revolves around center 29 of the square; when apex X is oriented toward a corner, center 128 is closer to apex X than center 29, and when apex X is tangent to a side as in FIG. 14B, center 128 is on the opposite side of center 29. Such a rounded regular pentagon is a closed curve of constant width and may be drawn by placing a compass on each corner of a regular pentagon and connecting the two opposite corners with an arc. As with the preferred Reuleaux triangle, guiding means may be constructed to direct the paths of various points on a shelf of such a shape as they may be plotted by rotating the figure and marking their movement within a square area. The apexes will describe straight lines on the sides of a distance shown by movement of apex Y from FIG. 14A to FIG. 14B, and will then move away from the sides and corners, creating a four-sided path with quite rounded corners. A track may be constructed on such a path for bearings on the apexes of the pentagonal shelf.

Figure 15:
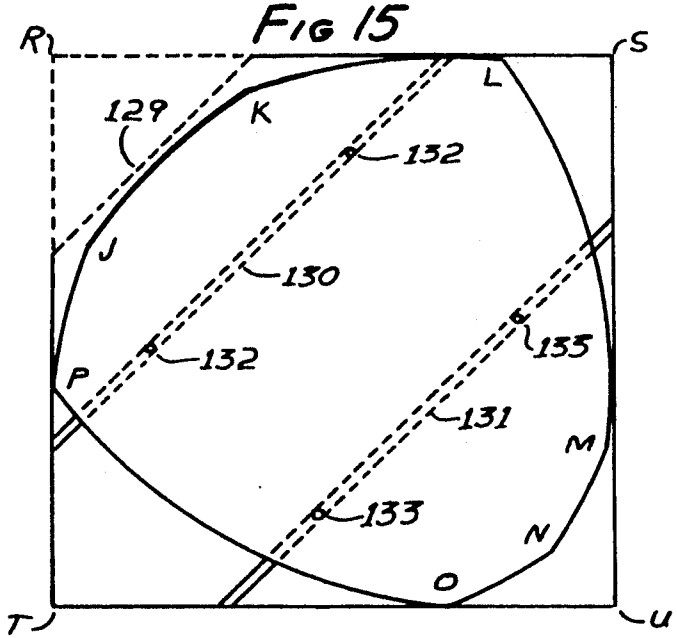

In FIG. 15, a geometric figure JKLMNOP is shown residing in a square area RSTU having a dotted line 129 representing an inside corner of a set of kitchen cabinets. This figure JKLMNOP is an example of an infinite number of curves of constant width which may be drawn following the directions in the Scientific American article cited in the Background of the Invention, and which is incorporated herein by reference. In this case, it will be observed that each of the seven points JKLMNOP has an arc opposite it, each arc having the same radius as the others, i.e. the distance, for example, from point J to points M and N. Arc NO has as its origin point X, arc OP has as its center point L, and so forth, the radius in each case being identical. Such a figure will rotate within square RSTU, at all times touching all four sides of the square. A shelf in such a shape may be supported by "cross-pieces" 130 and 131 having bearing points 132 and 133 but should desirably also be restrained around the edges by an L-profile or c-profile extension forming an outline of the square area in which it is to be retained.

Figure 16:
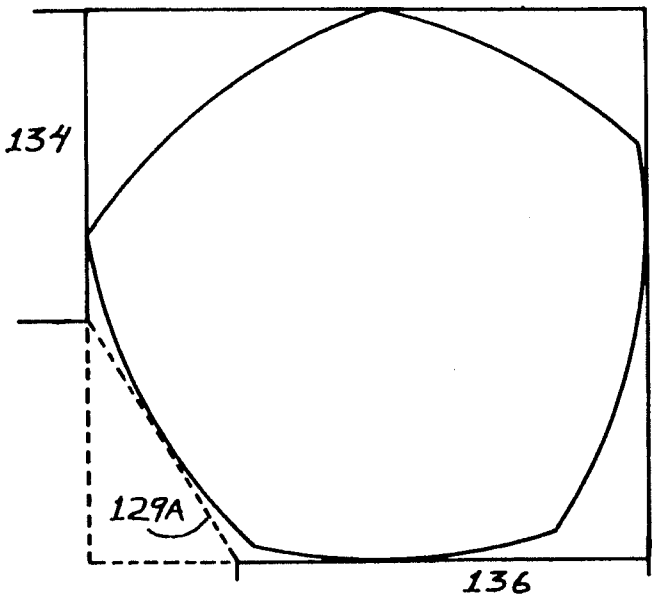

FIG. 16 is an irregular five-sided curve of constant width placed in a square having a dotted line 129A representing an offset inside corner door for the corner cabinet which is adjacent to a relatively shallow cabinet 134 on one side and relatively deep cabinet 136 on the other. This irregular 5-sided figure has rounded sides which are arcs drawn with equal radii from their opposite apexes. As with the shape of FIG. 15, this shape may also be supported on "cross-pieces" and guided by a square restraining frame on the sides of the square area. The shapes of FIG. 15 and 16 will rotate within the square area shown by the dotted lines, to project each apex from the inside cabinet corner in a different degree and to recess into the corner in varying orientations to accommodate a door or other access from the inside corner of the cabinets.

I may use in my invention a shelf shape of any closed curve of constant width other than a circle - that is, I may use any closed curve of constant width having in its perimeter more than one curve. Closed curves of constant width, as discussed in the above mentioned Scientific American article, may have perimeters of complex curves or may more simply be based on connected arcs drawn from various points. By definition, the closed curve of constant width has no straight line or concave portions, i.e. it is entirely convex. In any event, the circle, heretofore employed in the common "lazy susan" of the prior art corner cabinet, has only one curve or arc. I may use any closed curve of constant width having more than one curve (an arc being of course a type of curve). However, I prefer to use the Reuleaux triangle (which obviously has three arcs) even though it has the smallest area of any closed curve of constant width which will fit in a given square, because of its regularity, convenience of guiding, and its dramatic projection outside the cabinet as shown FIG. 5E.

Figure 17:
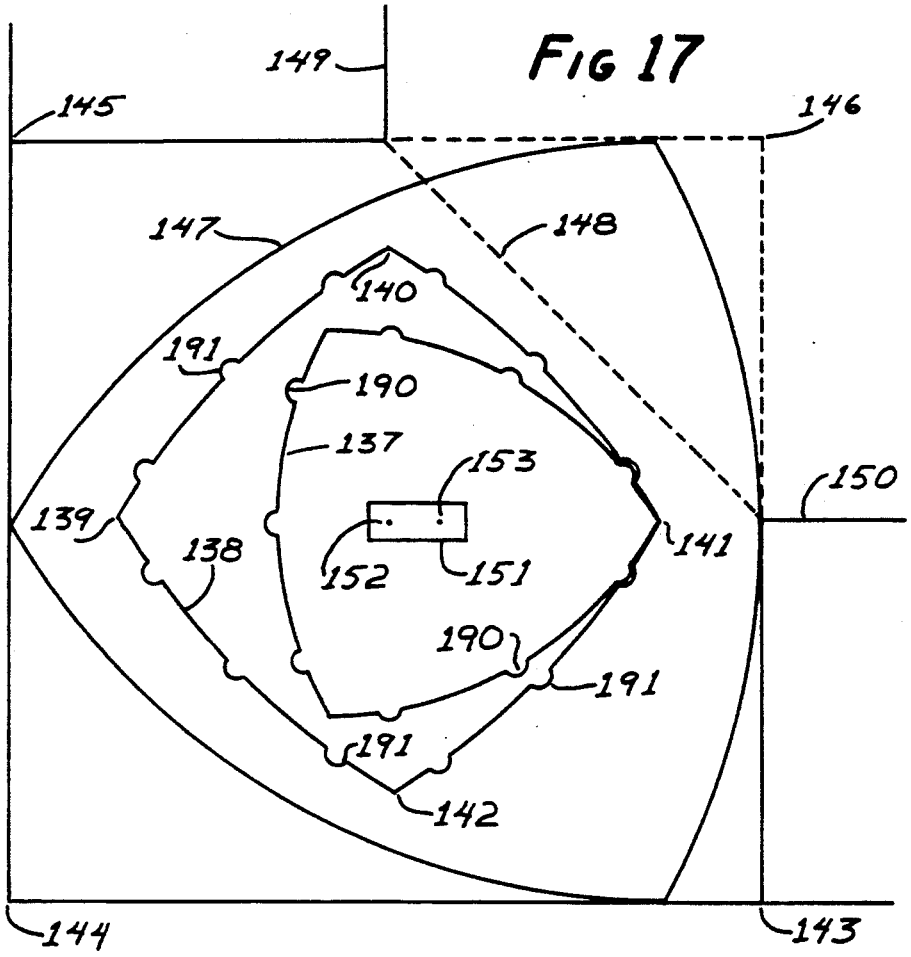

Reverting to the Reuleaux triangle, FIG. 17 shows an adaptation of the Reuleaux "centroid" which may be used to guide the Reuleaux triangle type of shelf. Franz Reuleaux showed that the points of the triangular curve of constant width which form the smaller inverted triangle 137, the "centroid", will "roll" in the convex square 138 having corners 139, 140, 141 and 142 which is formed of arcs projected from corners 143, 144, 145 and 146 of the square area in which the Reuleaux triangle, in this case represented as shelf 147, rotates. The centroid 137 is itself a Reuleaux triangle fixed to Reuleaux triangle shelf 147 so they turn together; its sides are in the shape of arcs having radii the length of the distance between corners, for example 140 and 141, of the convex square 138. Corner 146 of the square area in which the shelf turns is formed by a dotted line because it is of course not part of the cabinet structure. It will be seen that the orientation of the convex square 139-140-141-142 is such that a 135° door 148 may be placed across the inside corner of wall cabinet faces 149 and 150 without interfering with the centroid guide mechanism. Linkage 151 joins center 153 of the centroid 137 to center 152 of the square area 143-146, keeping them the appropriate distance apart, e.g. so that center 153 will revolve around center 152 at a distance 0.0773 of the dimension of square 143-146. Center 152 should be supported such as by a post or crosspiece; center 153 may be supported on a bearing which moves in a small circular track since it will, as explained in FIG. 5, move in a circle. Other support may be provided with cross-pieces having upright bearings as explained elsewhere herein. Lugs 190 on the centroid and recesses 191 on the convex square 138 roll surface may be employed to provide leverage.

Figure 18:
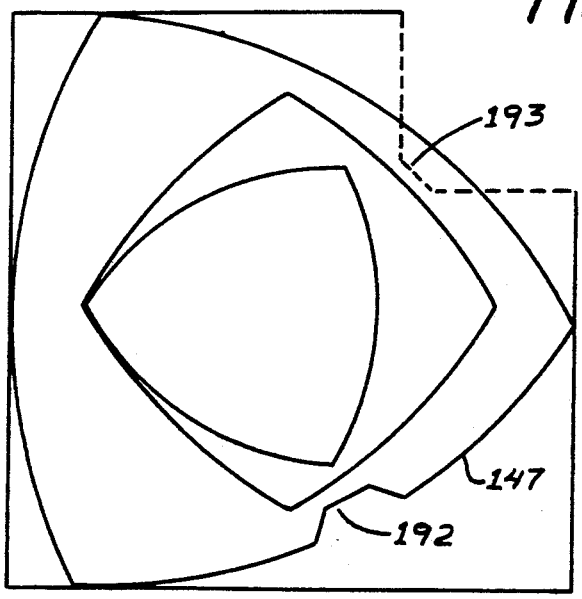

FIG. 18 shows a "centroid" configuration wherein a small portion of the shelf 147 is cut out at 192 to accommodate an inside corner 193 for the adjoining cabinets.

Figure 19:
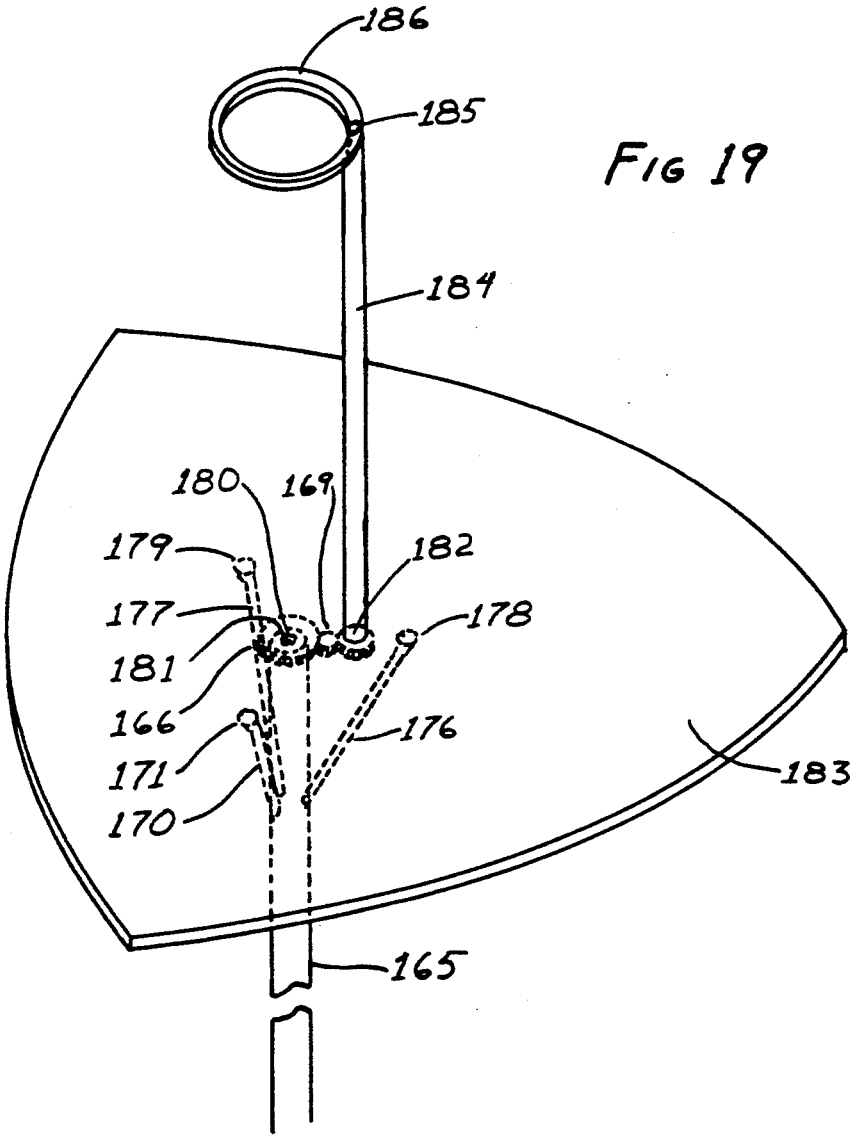

FIG. 19 illustrates the use of a small circular track 186 to be mounted under the countertop of the cabinet, which will provide stability for the shelf. It is shown with the planetary system of FIGS. 12 and 13, although such a stabilizing attachment may be used with any of my embodiments as an alternative to the preferred floor and countertop bearings of FIG. 8. In FIG. 19, post or shaft 165 is shown underneath the shelf 183. Post 165 need not turn (and sun gear 166 should not turn), and so may be anchored directly to the floor. Post 165 is desirably connected to and supports sun gear 166 which is located at the center of the square not shown. Planetary gear train 169 is deployed as in FIGS. 12, and 13. Post 165 has extensions 170, 176, and 177 with upright bearings 171, 178 and 179 to stabilize the shelf. An upright bearing 180 may also be used on top of center 181 of the sun gear 166. Attached to the top of the shelf 183 at its center 182 is another shaft or post 184 terminating at bearing 185 riding in circular track 186, which is anchored to the underside of a countertop not shown. The shelf 183 is thus supported at four points, 171, 178, 179 and 180, and may also be guided or stabilized by optional assembly 184, 185 and 186.

Where it is considered undesirable to have central posts or supports and separate shafts or other connections to the center of the shelf, I prefer to use runners or tracks as illustrated in FIGS. 6 and 7. On the other hand, the planetary gear system of FIGS. 12, 13, and 19 is relatively small compared to the other guiding systems. It can be molded readily from durable plastic such as nylon or Delrin, but should be strong enough to withstand the torque which will be placed upon it.

The kinematic path of any point on the Reuleaux triangle or any other closed curve of constant width may easily be traced mechanically by simply mounting a marking device on the shelf and turning it within a square; runners or tracks for friction-reducing bearing points may then be constructed following the kinematic movement of the points which may then be used also as supports if desired as shown in FIGS. 6 and 7. Any kinematic path of a point on a shelf confined in a square as described above which requires permanent support outside the cabinet door will tend to defeat the purpose. A perimeter path such as in FIG. 6 may be used for regular geometric shapes such as that of FIG. 14 - it should be observed, however, that the corners of the square will be considerably more rounded than is the case with the triangle. Since a bearing may be placed on each of the five "corners" of the FIG. 14 shape, however, the shelf is not necessarily rendered unstable when one of them leaves the track to be projected outside the cabinet space. Various track patterns may be generated on a computer through the use of a BASIC program for hypocycloid generation presented by Gary Cramblitt in the May 1985 issue of REMARK, page 30, published by Heathkit and incorporated herein by reference. The positions of XPT and YPT in lines 600 and 610 may be modified to project them as in a Reuleaux triangle by adding multiples or other functions of the formulas shown.

The FIG. 7 configuration is the largest and hence the most stable runner or track path which does not protrude from a 45° door such as in the configuration of FIG. 7, i.e. where the depth of the cabinet is about half the side of the square in which the shelf rotates. A kinematic track such as that shown in FIG. 7 may be mounted directly on the shelf by first fixing the bearings on the shelf at the centers of the edges of the arcs and then setting the bearings in the track; brackets may be attached to the rounded corners of the trackway for ready fastening to the walls. The runners or tracks which I prefer to use can he mounted on the shelf and the friction-reducing bearings mounted on a supporting surface as well as the opposite arrangement illustrated herein. The friction- reducing bearings, for example, could be single-socket ball bearings supported at at least three points by simple cross-pieces in the cabinet; the track mounted on the underside of the shelf, in the correct pattern for the position of the bearings, will guide the shelf in the desired square confinement. The track or runners, in fact, may be mounted around the edges of the shelf with appropriate friction-bearing points so that the shelf and runners may be sold as a unit, the bearings serving to hold them together. Likewise the various rotors and cam surfaces of FIGS. 9, 10, 11, and 17 may be attached to the shelf on manufacture, as well as the gears of FIGS. 8, 12, 13 and 19.

Variations of my invention which employ a post or shaft such as shown in FIG. 8 may have more than one shelf on them, in which case all such shelves will rotate together. Cabinets having tracks or runners such as in FIG. 6 or 7 will have independently moving shelves.

Although FIG. 8 shows my invention disposed between a floor and a counter top in a base cabinet, persons skilled in the art will recognize that it is operative for wall cabinets as well, as are all the variations illustrated herein.

The reader will recognize that my shelf may have a 90° wedge removed from it in the manner of the prior art such as in FIG. 2, and as illustrated in FIG. 18 and discussed with respect to FIG. 10 and elsewhere herein, so long as the rotation guidance system is operative; however, my con figuration permits a smaller sacrifice of shelf space - in any event, such a mutilated shelf is still considered herein to be in the shape of a Reuleaux triangle and/or other closed curve of constant width. The term "Reuleaux triangle" as used herein is also intended to include the expanded Reuleaux triangle such as described in U.S. Pat. No. 3,399,320 and in the diagram on page 152 of the Scientific American article in which this particular geometric figure is called a "symmetrical rounded-corner curve of constant width," which will also rotate within a square area.

While various workers in the past have studied the geometry and kinematics of the rotation of closed curves of constant width, particularly the Reuleaux triangle, it is believed that, prior to the present invention, workers in the cabinet art have not perceived that a rotatable corner shelf rotates in an essentially square area although the square area necessarily has a corner missing or mutilated to provide access to the interior, and that this essentially square area provides an opportunity for the installation of a shelf in the shape of a Reuleaux triangle or other closed curve of constant width which can be rotated within it.

While I have described various presently preferred designs and configurations, my invention may be otherwise variously practiced and embodied within the scope of the following:

I claim:

1. A shelf in the shape of a Reuleaux triangle, having means for guiding its rotation within a fixed square area to maintain said shelf substantially at all times in contact with all four sides of said square area.

2. A shelf of claim 1 wherein the rotation guiding means include bearing means and guide means therefor.

3. A shelf of claim 1 wherein the rotation guiding means include means for guiding the revolution of the center of the shelf around the center of said square area in a direction opposite that at which said center of said shelf rotates and at a rate of three degrees of revolution around the center of said square area for each degree of rotation.

4. A shelf of claim 1 including means for attaching said means for guiding said shelf to a cabinet.

5. A shelf of claim 1 wherein the means for guiding the rotation of said shelf include runners in a pattern to guide the rotation of said shelf within said square area.

6. A shelf of claim 1 wherein the rotation guiding means include bearing means and a trackway therefor in a pattern to guide the rotation of said shelf within said square area.

7. A shelf of claim 1 wherein the means for guiding the rotation of said shelf are in a pattern to guide a point on the shelf substantially near the center of a rounded edge of the shelf when said shelf rotates within said square area.

8. A cabinet having at least one shelf in the shape of a Reuleaux triangle and means for rotating said shelf within a square area whose sides are substantially tangent to said shelf to maintain said shelf in contact with all four sides of said square area substantially throughout its rotation.

9. A cabinet of claim 8 having a door normally closed at about 135° to two of the sides of said square area.

10. A cabinet of claim 8 including gear means for guiding the rotation of said shelf.

11. A cabinet of claim 8 built into a corner of a room having walls which form said corner, said square area being partly defined by the walls which form said corner.

12. A cabinet of claim 8 built into a corner formed by the junction of one or more cabinets on a first wall and one or more cabinets on an adjacent wall.

13. A cabinet having a shelf in the shape of a Reuleaux triangle, said cabinet defining a substantially square area for confining said shelf, means for guiding the rotation of said shelf within said square area to maintain said shelf substantially tangent to all four sides of said square area, and a door in said cabinet providing access to said shelf through a corner of said square area.

14. A cabinet of claim 13 having a plurality of shelves in the shape of a Reuleaux triangle.

15. A cabinet of claim 13 built into a corner formed by the junction of a plurality of base cabinets on adjacent walls.

16. A cabinet of claim 13 mounted on a wall of a kitchen.

17. A cabinet of claim 13 wherein the door is set substantially at a 45° angle in said corner of said square with respect to two of the sides of said square.

18. A cabinet of claim 13 including at least one friction reducing support for said shelf at a point directly inside said door.

19. A rotatable shelf in the shape of a closed curve of constant width having more than one curve, and means associated with said shelf for guiding the rotation thereof within a fixed square area to maintain said shelf in contact with all four sides of said fixed square area substantially throughout the rotation of said shelf.

20. Shelf of claim 19 in the shape of a closed curve of constant width having three arcs.

21. Shelf of claim 19 in the shape of a closed curve of constant width having five arcs.

22. Shelf of claim 19 in the shape of a closed curve of constant width having seven arcs.

23. Shelf of claim 19 modified on at least one side so as not to occupy a pre-defined portion of said square area which it would otherwise occupy in at least one orientation within said square area.

24. Shelf of claim 1 wherein the means for guiding include a Reuleaux centroid and a roll surface therefor in the shape of a convex square of arc sides having radii of the dimension of said square area from each corner thereof.

25. Shelf of claim 1 wherein the means for guiding includes a Reuleaux centroid, a convex square roll surface therefor, and a linkage between the center of said shelf and the center of said square area.

26. Shelf of claim 1 wherein the means for guiding include a stationary gear for the center of said square area, having a diameter about 0.062 of the width of said shelf, a planetary gear thereon about $\frac{3}{8}$ of the size of said stationary gear, and a rotating gear engaged with said planetary gear about $\frac{3}{4}$ the size of said stationary gear and fixed to the center of said shelf, said gears held in working relationship by a yoke and having numbers of gear teeth in a ratio of 8:3:6.

27. Shelf of claim 1 including means for attaching said shelf above and below while permitting the rotation of said shelf.

28. Shelf of claim 1 wherein the means for guiding include an internal gear set in a ratio of 4:3, the centers of said gear set being fixed at a distance from each other about 0.0773 of the width of said shelf.

29. Shelf of claim 1 modified on at least one side so as not to occupy a pre-defined portion of said square area which it would otherwise occupy in at least one orientation within said square area.

30. Cabinet of claim 8 having support means for said shelf which include a post anchored above and below the center of said square area and attached to said shelf at its center.

* * * * *

UNITED STATES PATENT AND TRADEMARK OFFICE

CERTIFICATE OF CORRECTION

PATENT NO. : 5,152,592

DATED : Oct. 6, 1992

INVENTOR(S) : William L. Krayer

It is certified that error appears in the above-identified patent and that said Letters Patent is hereby corrected as shown below:

The title page should be deleted to appear as per attached title page.

Signed and Sealed this

Twenty-third Day of March, 1993

*Attest:*

STEPHEN G. KUNIN

*Attesting Officer*

*Acting Commissioner of Patents and Trademarks*

US005152592A

United States Patent [19]

Krayer

[11] Patent Number: 5,152,592

[45] Date of Patent: Oct. 6, 1992

[54] CORNER CABINET

[76] Inventor: William L. Krayer, 1623 Tiffany Ridge, Pittsburgh, Pa. 15241

[21] Appl. No.: 898,651

[22] Filed: Aug. 21, 1986

Related U.S. Application Data

[63] Continuation-in-part of Ser. No. 821,047, Jan. 22, 1986, abandoned.

[51] Int. Cl.[5] ..... A47B 81/00

[52] U.S. Cl. ..... 312/238; 312/305

[58] Field of Search ..... 312/238, 305, 125, 135, 312/11, 350; 279/16; 108/94, 104, 139, 142, 20; 211/144

[56] References Cited

U.S. PATENT DOCUMENTS

| | | | |
|---|---|---|---|
| D. 211,527 | 6/1968 | Rowland | D6/489 X |
| D. 215,735 | 10/1969 | Melvin | D6/489 X |
| D. 262,169 | 12/1981 | Sonder et al. | D6/489 X |
| 1,241,175 | 9/1917 | Watts . | |
| 1,241,176 | 9/1917 | Watts . | |
| 1,241,177 | 9/1917 | Watts . | |
| 2,239,734 | 4/1941 | Pratt . | |
| 2,628,880 | 2/1953 | Kader . | |
| 2,629,643 | 2/1953 | Davidson . | |
| 2,680,660 | 6/1954 | Stephens . | |
| 2,693,401 | 11/1954 | Brown . | |
| 2,840,438 | 6/1958 | Sharpe | 211/144 X |
| 3,160,453 | 12/1964 | Tassell . | |
| 3,198,594 | 8/1965 | Murray . | |
| 3,369,320 | 2/1968 | Hronas et al. . | |
| 3,922,120 | 11/1975 | McCullough et al. . | |
| 4,012,077 | 3/1977 | Roepke et al. . | |
| 4,062,595 | 12/1977 | Roepke et al. . | |
| 4,074,778 | 2/1978 | Morrell et al. . | |
| 4,124,262 | 11/1978 | Schill . | |
| 4,146,280 | 3/1979 | Crownhart . | |
| 4,191,437 | 3/1980 | Funke . | |
| 4,330,696 | 5/1982 | Pomeroy et al. | 108/20 X |
| 4,392,628 | 7/1983 | Hadfield . | |
| 4,433,885 | 2/1984 | Baker . | |
| 4,434,343 | 2/1984 | Bowen et al. | 108/20 X |

FOREIGN PATENT DOCUMENTS

| | | | |
|---|---|---|---|
| 803415 | 4/1951 | Fed. Rep. of Germany | 211/144 |
| 965431 | 9/1950 | France | 312/305 |

OTHER PUBLICATIONS

The Kinematics of Machinery by Franz Reuleaux, Dover Publications, pp. 131-168.

Scientific American, Feb. 1963, pp. 148-156, article by Martin Gardner, "Mathematical Games".

REMark, May 1985, pp. 30 et seq. "Spiral Magic on the H/Z 100" by Gary Cramblitt.

*Primary Examiner*—Joseph Falk

[57] ABSTRACT

A shelf arrangement is disclosed for a corner cabinet, particularly for a built-in cabinet such as is commonly used in kitchens. The shelf is shaped as a closed curve of constant width, preferably triangular. The shelf turns in the confines of a square-shaped corner cabinet space; a corner of the shelf will protrude through a 45° or 90° corner door for accessibility and is recessed when the door is closed. The shelf may rest on a track forming a kinematic path for the rotation of the shelf such as around the inside periphery of the cabinet or may be mounted on a central post or other support means with a gear or rotor system of special design to facilitate turning.

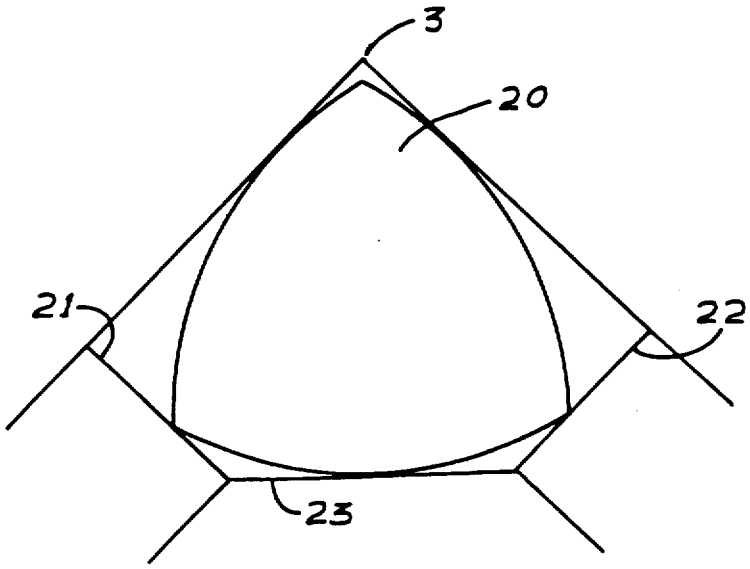

30 Claims, 12 Drawing Sheets